US005791385A

United States Patent [19]

Stahlecker

[11] Patent Number: 5,791,385

[45] Date of Patent: Aug. 11, 1998

[54] ARRANGEMENT AND METHOD FOR FILLING CONTAINERS WITH A LIQUID WITH A TENDENCY TO FOAM

[75] Inventor: Werner Stahlecker, Stuttgart, Germany

[73] Assignee: Ruediger Haaga GmbH, Altoberndorf, Germany

[21] Appl. No.: 701,867

[22] Filed: Aug. 23, 1996

[30] Foreign Application Priority Data

Sep. 9, 1995 [DE] Germany ..... 195 33 462.0

[51] Int. Cl.[6] ..... B65B 35/00

[52] U.S. Cl. ..... 141/171; 141/130; 141/165; 141/263; 141/270; 141/271; 141/374

[58] Field of Search ..... 141/130, 165, 141/171, 254, 260, 263, 270–272, 370, 372–374; 220/712, 713, 716

[56] References Cited

U.S. PATENT DOCUMENTS

| | | | |
|---|---|---|---|
| 582,285 | 5/1897 | Henes et al. | 141/372 |
| 651,274 | 6/1900 | Schneider | 141/271 |
| 670,395 | 3/1901 | Champ | 141/272 |
| 857,674 | 6/1907 | Riecke | 141/372 |
| 924,360 | 6/1909 | Kirkegaard | 141/372 |
| 1,224,249 | 5/1917 | Weiss | 141/171 |
| 2,839,094 | 6/1958 | Reno | 141/263 |
| 3,105,526 | 10/1963 | Hurtig | 141/171 |
| 4,141,462 | 2/1979 | Rucci | 220/713 |
| 4,366,914 | 1/1983 | Ingram | 220/713 |
| 4,721,138 | 1/1988 | Simonazzi | 141/372 |
| 5,086,817 | 2/1992 | Murphy | 141/271 |
| 5,143,248 | 9/1992 | Sawatsky | 220/713 |
| 5,219,405 | 6/1993 | Weiss | 141/372 |
| 5,368,186 | 11/1994 | Yeh | 220/713 |

FOREIGN PATENT DOCUMENTS

| | | | |
|---|---|---|---|
| 0 479 010 A1 | 4/1992 | European Pat. Off. . | |
| 2024779 | 1/1980 | United Kingdom | 141/171 |

*Primary Examiner*—J. Casimer Jacyna
*Attorney, Agent, or Firm*—Evenson, McKeown, Edwards & Lenahan, P.L.L.C.

[57] ABSTRACT

An arrangement and a method for filling containers with a liquid which tends to form foam, in which the container and the filling nozzle are positioned in relation to each other in such a way that the impact of the stream of liquid pouring out of the filling nozzle is reduced. The liquid stream guided through the filling opening of the container lid is directed preferably against the inner sleeve surface of the container.

31 Claims, 5 Drawing Sheets

FIG. 1 PRIOR ART
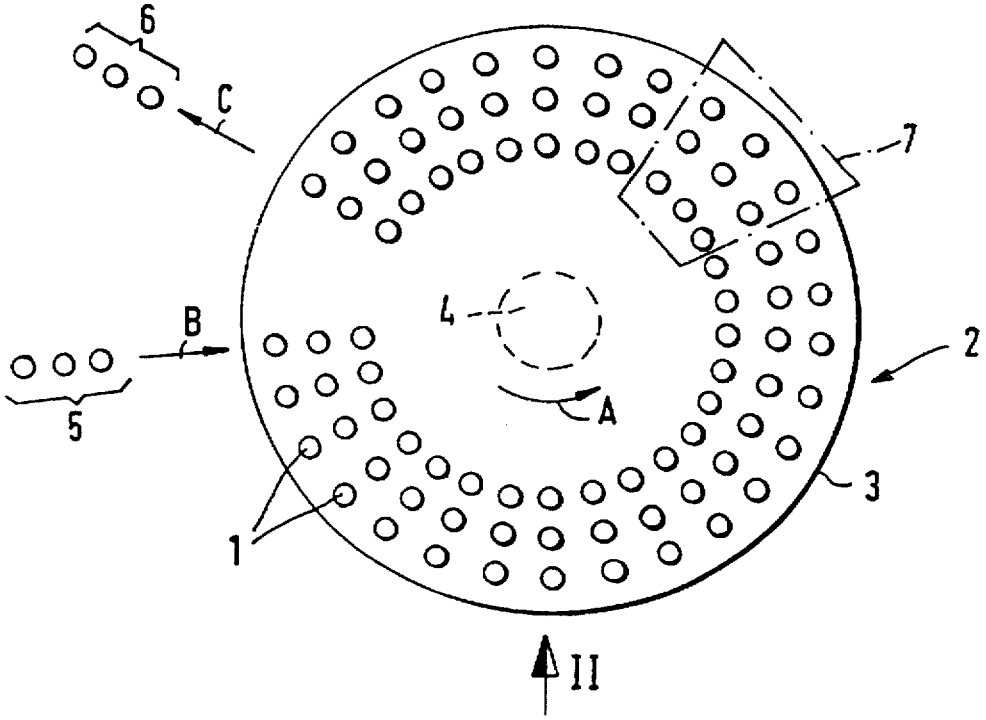
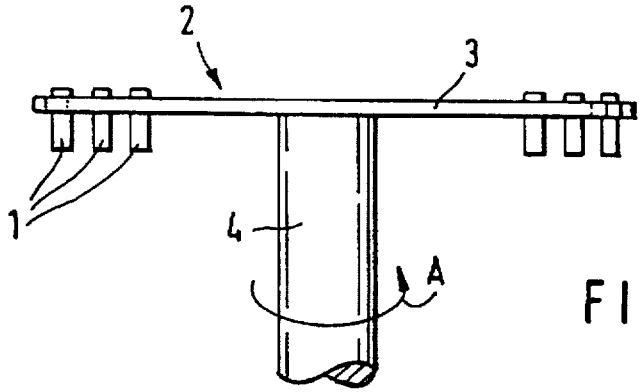
FIG. 2 PRIOR ART

ARRANGEMENT AND METHOD FOR FILLING CONTAINERS WITH A LIQUID WITH A TENDENCY TO FOAM

BACKGROUND AND SUMMARY OF THE INVENTION

The invention relates to an arrangement and a method for filling containers with a liquid, particularly a liquid with a tendency to foam, using a filling nozzle directed through a filling opening of the container against the inside thereof, and also using a transporting device which positions the containers with their filling openings to the filling nozzle, said transporting device having at least one container receiver.

A device of the type generally described above is known from European Patent Document EP 0 479 010 A1. Here the transport means is a rotating sequencer table, which comprises a location hole with a receiver in the form of a clamping holder for each container. The containers are filled at a filling station in such a way that a stream of liquid pouring from the filling nozzle is directed from a distance through the filling opening of the container and against the bottom of the container. A stream of liquid of this type inevitably has a high impetus and tends to form foam.

It is an object of the invention to dampen the impact of the liquid stream and to reduce the tendency to form foam.

This and other objects have been achieved in accordance with the present invention by providing a positioning device with which the filling nozzle and the container receiver are adjustable relative to one another during the filling process in such a way that the impact of the stream of liquid flowing out from the filling nozzle is reduced.

This and other objects have been achieved in accordance with the present invention by providing an arrangement for filling containers with a liquid which tends to form foam, comprising a transporting device is arranged and configured to align a filling opening of a container with a filling nozzle, said transporting device having at least one container receiver configured to support the container; a filling nozzle configured to direct a filling stream of a liquid through the filling opening of the container into an inside of the container; and a positioning device arranged and configured to adjust the position of at least one of the filling nozzle and the container with respect to the other of the filling nozzle and the container such that an impact of the filling stream against the inside of the container is reduced.

This and other objects have been achieved in accordance with the present invention by providing a method for filling containers with a liquid which tends to form foam, said method comprising the steps of aligning a filling opening of a container with a filling nozzle by way of a transporting device having at least one container receiver configured to support the container; directing a filling stream of a liquid from the filling nozzle through the filling opening of the container into an inside of the container; adjusting the position of at least one of the filling nozzle and the container with respect to the other of the filling nozzle and the container with a positioning device such that an impact of the filling stream against the inside of the container is reduced.

The present invention can be realized in many different ways. For example, the free-fall height of the filling stream can be reduced, or the angle of impact of the filling stream against the container wall can be varied. The container and filling nozzle can be positioned in the desired way beforehand, or they can be positioned suitably during the filling procedure. In any case, a lessening of the impact of the filling stream can reduce foam formation. These measures lead to a faster filling of the containers and thus to a higher number of cycles of the arrangement, i.e., a faster cycle time.

In the case of one embodiment, the positioning device comprises an adjusting device arranged on the filling nozzle and/or the container receiver, by means of which adjusting device the filling nozzle and the container bottom can be brought close together For example, the filling nozzle can be guided by means of axial adjustment through the filling opening into the container, so that the mouth of the filling nozzle is sufficiently near to the container bottom. In kinematic reverse, the container can, of course, be adjusted in a corresponding way over the stationary filling nozzle, i.e., the container can be axially guided toward the filling nozzle to bring the filling nozzle through the filling opening of the container. Thus, as soon as the liquid reaches a certain level, the nozzle will be submerged therein and foam formation is to a large extent prevented.

In another embodiment, the positioning device comprises an adjusting device arranged on the filling nozzle and/or the container receiver, by means of which adjusting device the filling nozzle can be directed at an angle against the inner sleeve surface of the container. Thus the filling stream flows not vertically against the wall of the container, but rather at a very acute angle, whereby the impact of the filling stream is effectively dampened.

In a preferred embodiment of the present invention, the filling nozzle can be vertically arranged and the container adjusted out of its vertical position. The original, quite complicated filling arrangement -remains unchanged in contrast to the standard designs, whereas the container can be brought into a suitable filling position by tilting which reduces the impact of the filling stream. According to the extent with which the container is filled, that is, with increasing fullness, it can return from its inclined position to a vertical position.

For the purpose of the present invention, the container receiver takes the form of an elastic clamping holder, and the adjusting device is in the form of a displacing device. A clamping holder has the basic advantage that it can seize a container quickly and securely. The elastic form permits the container to be displaced from the perpendicular to the desired limit. A separate displacing device moves the container into the desired position and returns it to its vertical position.

The container receiver can also comprise a pivotable gripper, to which a guiding bar or the like, belonging to the adjusting device, is arranged. Such a pivotable movement can be kinematically planned to a very exact degree, whereby the reverse movement into the vertical position is accomplished by a spring element.

In another embodiment of the invention the arrangement of parts can be such that a stationary filling nozzle is arranged directed inclined against the inner sleeve surface of the vertically positioned container. This embodiment is particularly simple as an adjusting device, whether on the container receiver or on the filling nozzle, can be omitted. The filling stream is still directed inclined against the inner sleeve surface, so that the impact of the jet of liquid is softened. This results in less foam formation.

If, with increasing fullness of the container, it is desired that the position of the filling nozzle be altered in its inclination to the container, then the filling nozzle can be pivotable around a real or imaginary swivel axis, whereby the swivel axis should lie, for practical reasons, in the area of the filling opening.

If an adjusting device is used, it is practical when, during the filling process, the adjusting device can be guided automatically back into its home position. With increasing fullness, the original impact surface of the filling stream is covered by the level of the rising liquid, so that from this point onwards, the container should be guided back into its home position. Experience has shown that an almost full container tends less towards foam formation.

These and other objects, features and advantages of the present invention will become more readily apparent from the following detailed description thereof when taken in conjunction with the accompanying drawings.

BRIEF DESCRIPTION OF THE DRAWINGS

FIG. 1 is a top view of a known transporting device in the form of a rotating sequencer table, for use in the arrangement according to the present invention;

FIG. 2 is a lateral view of the known sequencer table according to the arrow direction II of FIG. 1;

DETAILED DESCRIPTION OF THE DRAWINGS

Figure 3:
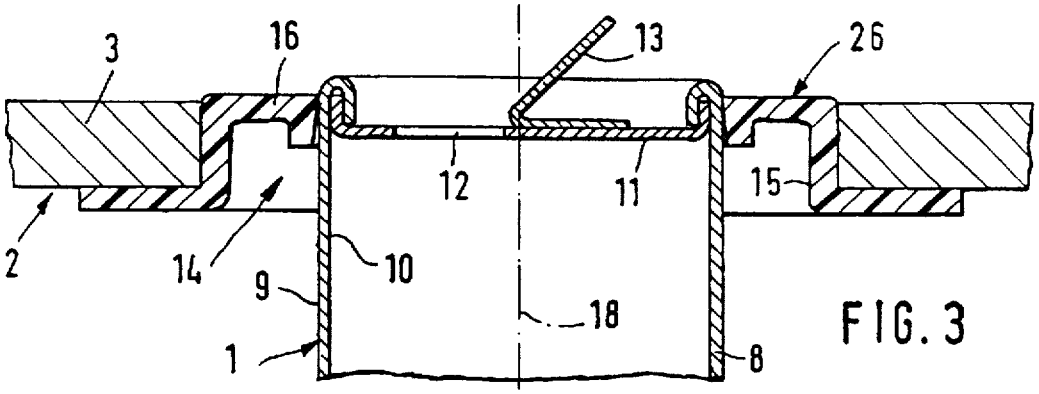
FIG. 3 is a greatly enlarged partial cross-sectional view of a container receiver in the transport device of an arrangement according to a preferred embodiment of the present invention.

In the case of the arrangement according to FIGS. 1 and 2, a plurality of containers 1 to be filled with a liquid are conveyed by a transporting device 2, which takes the form of a sequencer table 3. The sequencer table 3 is fixedly connected to a pillar 4, which rotates in time with the sequencer table 3 in arrow direction A.

The transport device 2 is continuously fed a triad 5 of containers 1 in arrow direction B; after filling and closing of the containers 1, a triad 6 of containers 1 are transported away in arrow direction C. A transport device of this kind is already described in the above mentioned European Patent Document EP 0 479 010 A1, which further describes the functioning of the transport device 2. A filling station 7 is denoted in FIG. 1 by dot-dash contours. The transported containers 1 are filled here with liquid. The stations between the point marked with an arrow B and the filling station 7 serve first and foremost to sterilize the containers 1. The stations located between the filling station 7 and the point marked with an arrow C serve first and foremost to close the filled containers 1. The stations downstream and upstream of the filling station 7 are not subject matter of the present invention.

In the enlarged representation according to FIG. 3, a container 1 held on the sequencer table 3 is shown, which in the present invention has the form of a drinking can made of paper. The container 1 preferably has a cylindrical sleeve 8, which is held with its outer circumference 9 in the sequencer table 3 and which is provided with an inner sleeve surface 10. The container 1 is closed at its base with a bottom (not shown in FIG. 3). Before filling, a lid 11 is applied to the other (top) end of the container 1, which is provided with a filling opening 12. The lid 11 already comprises a so-called pull tab 13, which functions later as a closing element, which closes and seals the filling opening 12 after the container has been filled, for example by sealing the pull tab 13 onto the corresponding outer wall of the lid 11. In order to hold the container 1 on the sequencer table 3 of the transport device 2, a container receiver 14 made of elastic synthetic material is provided, which takes the form of a clamping holder 26. This comprises a tube-shaped area 15, which is guided into, and sits snugly in, a corresponding receiver bore hole of the sequencer table 3. From the tube-shaped area 15, a membrane-like area 16 extends radially inwards, which area 16 is provided with a receiver bore hole for a container 1. The receiver bore hole is slightly smaller than the outer circumference 9 of the sleeve 8, so that the container 1 can be guided from below into the container receiver 14 and thereby held fast by means of a certain elastic contact pressure. The receiver bore hole in the membrane-like area 16 comprises a guiding slope, i.e. the receiver bore hole slopes radially inwardly from a lower portion to an upper portion, in order to aid the guiding-in of the container 1. During transport, the individual containers 1 are held in close proximity to the filling opening 12 at the outer circumference 9 of the sleeve 8. The individual containers 1 maintain this vertical position until they reach the area of the filling station 7.

The filling station 7 is provided with at least three filling nozzles 17 for a triad of containers 1. Preferably, however, a plurality of triads of filling nozzles 17 are arranged one after the other, in case various liquids, such as beverages, are to be filled into the containers 1. The respective filling nozzle 17 of a filling opening 12 is arranged in a non-movable way.

Figure 4:
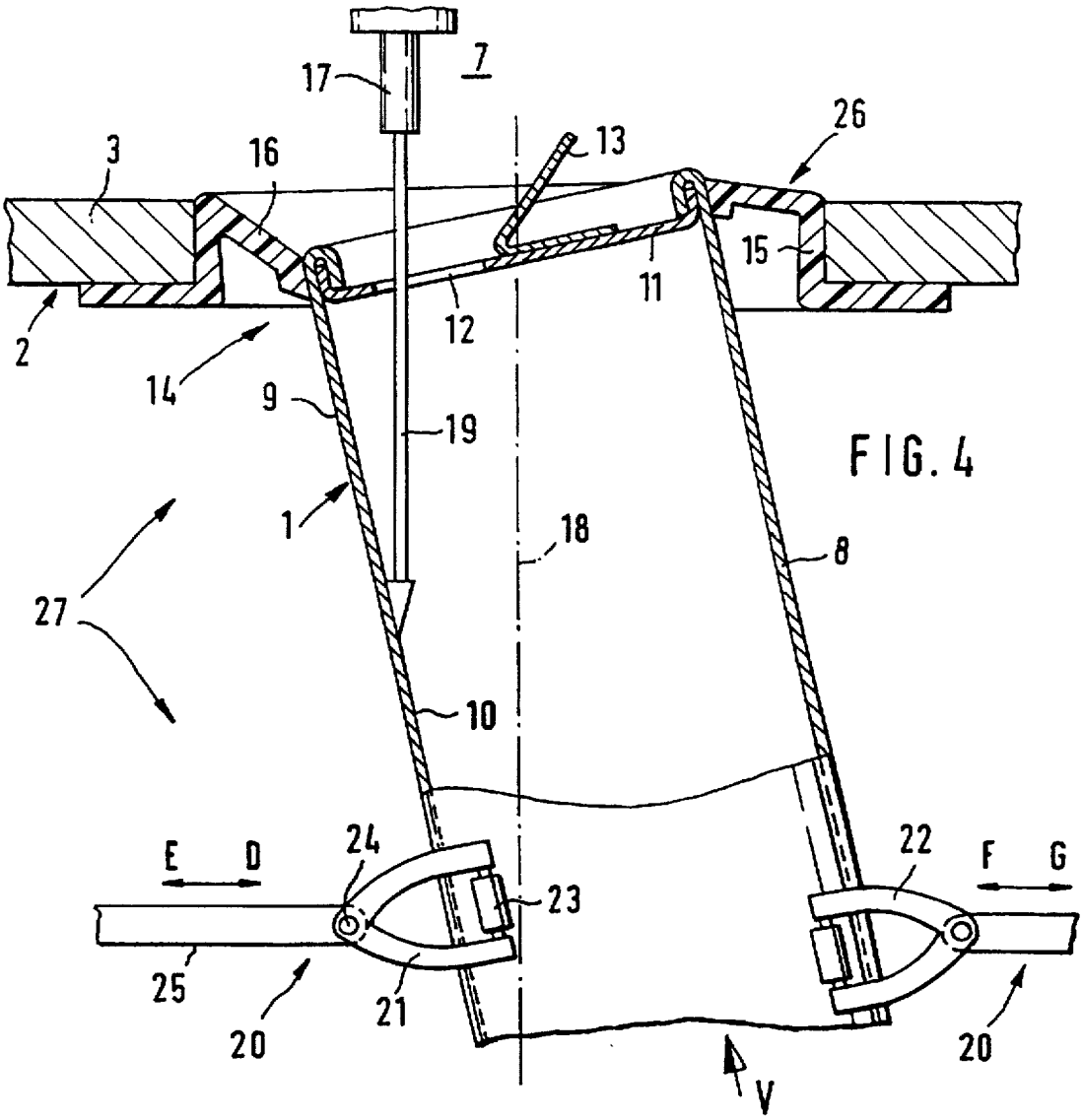
FIG. 4 is a view similar to FIG. 3, wherein the container is slightly inclined for filling.

Some liquids tend to form foam, caused among other things by the high impetus of the filling stream 19, which is denoted by an arrow in FIG. 4. In order to reduce the impact of the filling stream 19 and to reduce the foam formation, the container 1 is, according to the present invention, inclined during the first part of the filling process in such a way that the filling stream 19 is directed against the inner sleeve surface 10 in the upper area of the container 1. As soon the level of the liquid rises above the contact point of the filling stream 19 with the inner sleeve surface 10, the incline of the container 1 is successively reduced until the container 1 is again in its vertical position 18 by the end of filling process. In this way, the container 1 can be filled almost to the lid 11.

Figure 5:
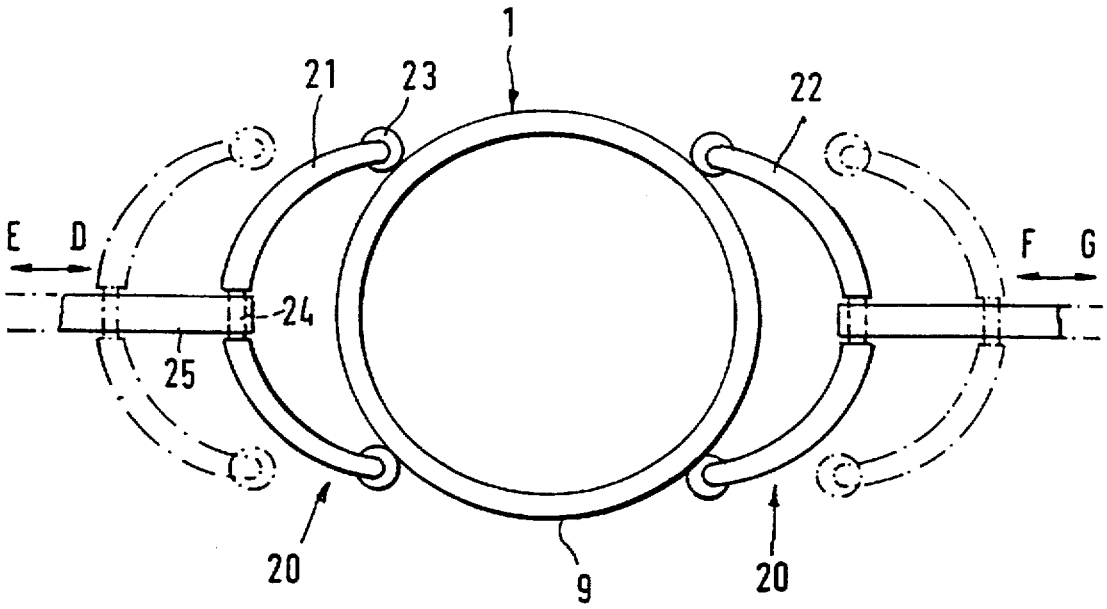
FIG. 5 is a view in the direction of the arrow V of FIG. 4 which shows the displacing device.

According to FIGS. 4 and 5, an adjusting device 20 is provided for tipping the containers 1 out of their vertical positions 18, which adjusting device 20 takes the form of a tipping device and which can be constructed in various ways. In the present embodiment, the adjusting device 20 comprises two pairs 21 and 22 of clamping fingers, which can, in accordance to the respective arrow directions D and E or F and G, be positioned on the container 1 or drawn back therefrom. While the container 1 is being tipped into position for guiding the filling stream 19 therein, the two pairs 21 and 22 of clamping fingers hold the container 1 in a pre-determined position, so that there is no risk that the container 1 can fall out of the deformed container receiver 14. The adjusting device 20 serves also to guide the container 1 back into its vertical transporting position.

The two pairs 21 and 22 of clamping fingers each comprise two locating rollers 23, which rest on the outer circumference 9 of the sleeve 8. In order that the pairs 21 and 22 of clamping fingers can align themselves to the incline of the container 1, they are slightly pivotable around a pin 24, to which a torsion spring is arranged, which torsion spring holds the pairs 21 and 22 of clamping fingers in their horizontal home position. The pairs 21 and 22 of clamping fingers are held by their respective pins 24 to an arm 25, which executes the movements according to the arrow directions D and E or F and G.

Other embodiments of the adjusting device 20 are, of course, possible. For example, a clamping device can be provided which comprises three fingers, whereby two fingers are positioned on one side of the container 1 and one finger is arranged on the other side. Alternatively, under certain circumstances it can be sufficient to position a pressure element to contact the container 1 instead of a clamping device, whereby the container 1, if desired under the additional action of a spring element, returns itself to its home position as a result of the elastic return motion of the container receiver 14.

In the present invention, the adjusting device 20, together with the elastic clamping holder 26, forms a positioning device 27, with which the filling nozzle 17 and the container receiver 14 are aligned to each other in such a way during the filling process that the impact of the filling stream 19 emitted from the filling nozzle 17 is reduced.

In the following embodiments, the references are retained insofar as an identical or at least functionally similar component is involved. A repeat description is therefore not given, and reference is made to the previous Figures.

Figure 6:
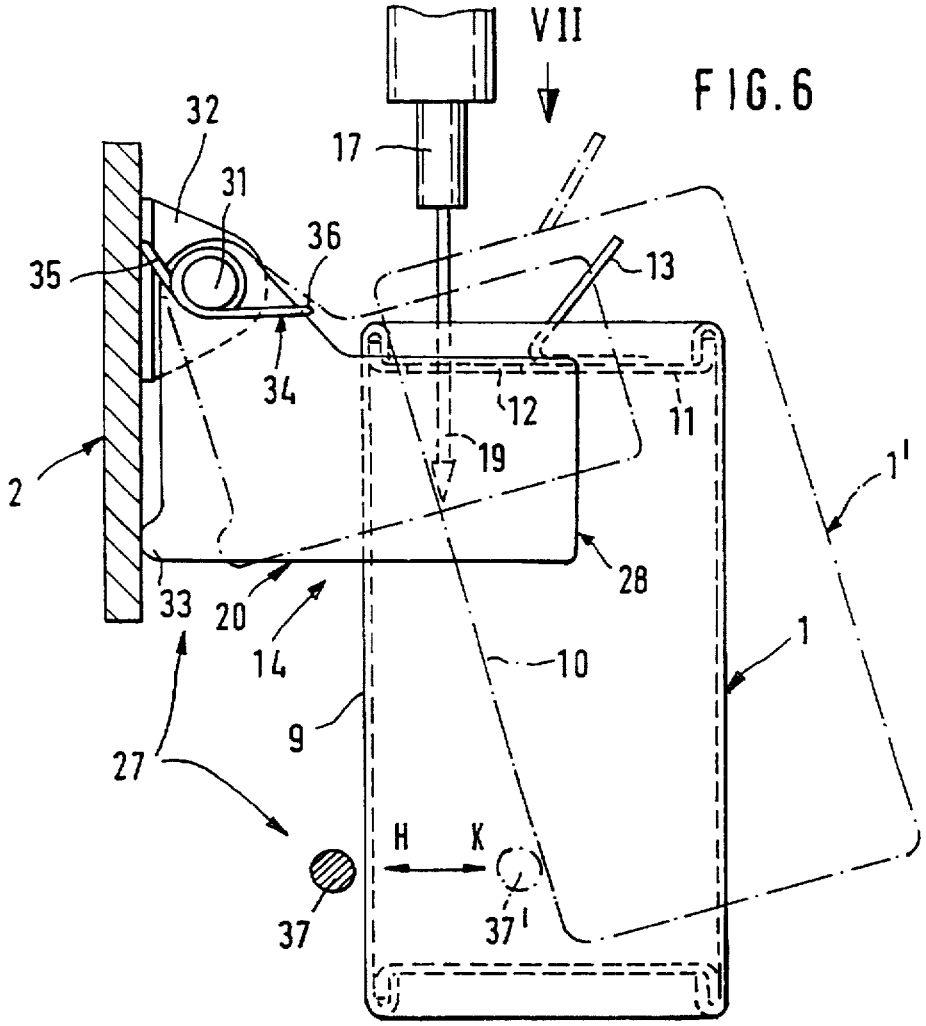
FIG. 6 is a lateral view of a container receiver comprising a, pivotable gripper according to another embodiment of the present invention.
Figure 7:
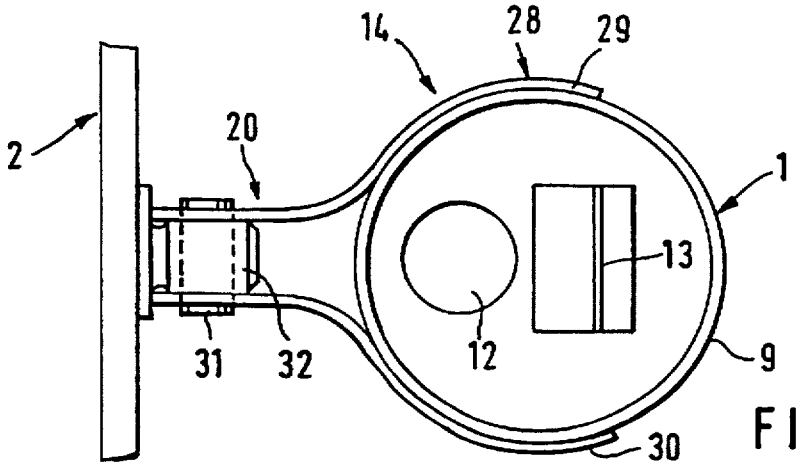
FIG. 7 is a view in the direction of the arrow VII of FIG. 6.

The embodiment according to FIGS. 6 and 7 diverges from the embodiments in FIGS. 3 and 4 essentially in that instead of an elastic clamping holder 26, a pivotable gripper 28 is provided, which, together with a guide bar 37, which will be described below, forms the positioning device 27.

The gripper, denoted by 28, comprises two pincer-like shaped, spring mounted gripping arms 29 and 30, which effect a closing movement and which are pivotable around a swivel axle 31 of a holder 32. The gripper 28 is provided with a stopper 33 with which it rests with the side facing away from the container 1 on a positioned stopping surface of the transport device 2. The transport device 2 is here in the form of a steel belt circulating on its edge or the like. A torsion spring 34 is located on the swivel axle 31, from which spring 34 one spring arm 35 rests against a stopping surface of the transport device 2 and the other spring arm 36 rests against the gripper 28 in such a way that the stopper 33 is pressed against the transport device 2.

By means of their resilient clamping effect, the two gripper arms 29 and 30 hold the container 1. A guide bar 37 which can be slid along according to the arrow directions H and K and which can preferably reach a plurality of containers 1, contacts at the outer circumference 9 of the container 1 and pivots it about swivel axis 31 together with the gripper 28 into an intermediate position denoted in FIG. 6 by a dot-dash line with the reference 1'. In this inclined position the container 1 can be filled through the filling opening 12 so that the filling. stream 19 lands with less force on the inner sleeve surface 10, whereby the impact of the filling stream 19 is reduced. With increasing fullness, the guide bar 37 returns in arrow direction H from its tipped position 37' to its home position, in which the container 1 is vertically adjusted under the action of the torsion spring 34.

In kinematic reverse, a stationary guide bar can be applied and the transport device can be laterally moved. However, the kinematics must be designed so that when the container 1 is moved the filling opening 12 essentially maintains its home position.

In the embodiment according to FIG. 8, a container receiver 14 is provided for the container 1, which container receiver 14 takes the form of a clamping holder 26 on the sequencer table 3, into which clamping holder 26 the container 1 can be guided from below. In this embodiment the container 1 maintains its vertical position at all times.

Figure 8:
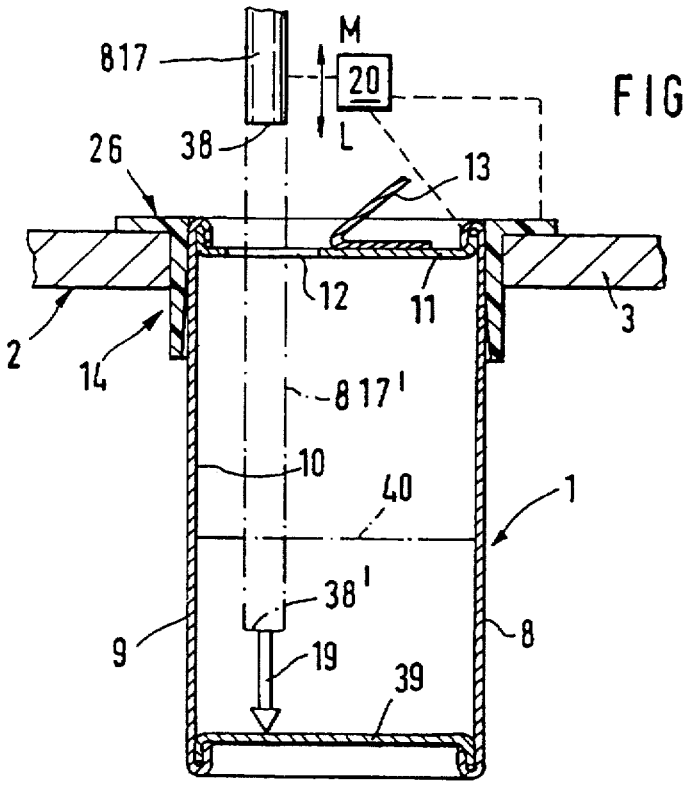
FIG. 8 is a lateral view of a filling nozzle lowered inside the container, according to another embodiment of the present invention.
Figure 9:
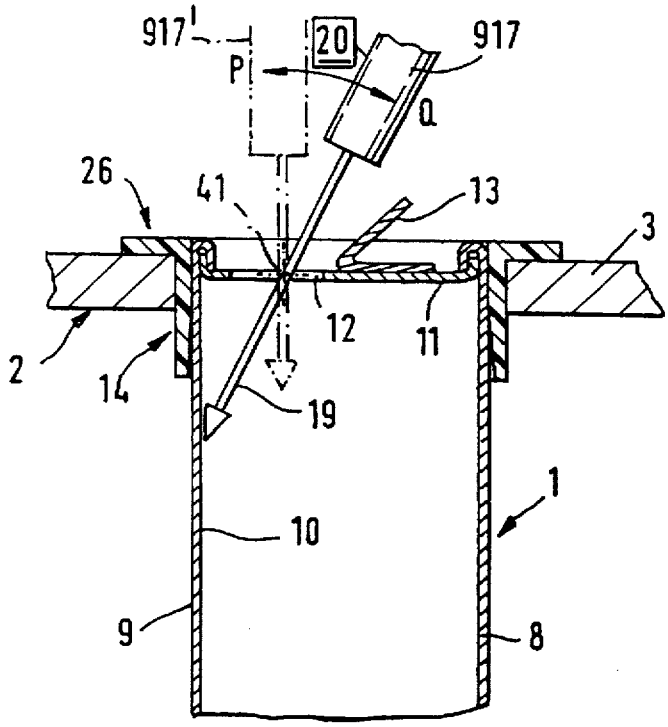
FIG. 9 is a lateral view of a container arranged vertically and a filling nozzle directed at an angle against the inner sleeve surface of the container, according to another embodiment of the present invention.

Instead of a tipping movement, an adjusting device 20, shown as a block element in FIGS. 8 and 9, axially slides the filling nozzle 817 according to the arrow directions L and M. Thus the filling nozzle 817 can be moved into a position 817, denoted by a dot-dash line, in which it is lowered into the container 1 through the filling opening 12. The mouth 38 of the filling nozzle 817 takes up a position 38' which is located in close proximity to the container bottom 39. The falling height of the filling stream 19 is then so low that the foam formation of the liquid is reduced.

With increasing fullness, the filling nozzle 817 can, of course, be withdrawn more and more in arrow direction M upwards and out of the container 1. It can also be advantageous if the filling nozzle 817 maintains its position 817' until the container 1 is completely full. The mouth 38 then has a position 38', which lies underneath the level 40 of the liquid, so that any foam formation is prevented. After the filling process has been completed, the filling nozzle 817 can be withdrawn entirely in arrow direction M through the filling opening 12 out of the container 1.

In kinematic reverse, a stationary filling nozzle 817 can be used and the adjusting device 20 can displace the container 1 toward the filling nozzle in such a way that the mouth 38 lies underneath the level 40 of the liquid. The adjusting device 20 may engage the container 1 and/or the container receiver 14, as schematically shown in dashed lines in FIG. 8.

According to FIG. 9, the container 1—as in FIG. 8—is held constantly vertical at the transport device 2. In this case a filling nozzle 917 is provided which is slightly inclined and also holds a stationary position. The positioning is such that the filling stream 19 emitted by the filling nozzle 917 is directed diagonally against the inner sleeve surface 10 of the container 1, namely in close proximity to the lid 11. The filling stream .19, guided through the filling opening 12, loses its impact significantly, which results in reduced foam formation.

If, with increasing fullness, it is desirable to return the filling nozzle 917 to a vertical position, then the filling nozzle 917 can alternatively be moved into a position 917' according to the dotted representation, see also arrow directions P and Q. The adjusting device (not shown) in this case would pivot the filling nozzle 917 around a preferably imaginary axis 41, i.e., an axis 41 which does not intersect with the filling nozzle 917 itself. The axis 41 should advantageously be in the area of the filling opening 12.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An arrangement for filling containers with a liquid which tends to form foam, comprising:

a transporting device arranged and configured to align a filling opening of a container with a filling nozzle, said filling opening being defined by a lid which covers an end of the container, said filling opening having a cross-sectional area which is less than a cross-sectional area of said lid, said transporting device having at least one container receiver configured to support the container;

a filling nozzle configured to direct a filling stream of a liquid through the filling opening of the container into an inside of the container; and a positioning device arranged and configured to adjust the position of at least one of the filling nozzle and the container with respect to the other of the filling nozzle and the container to form an angle of inclination between the filling nozzle and an inner sleeve surface of the container while said container is being supported by said container receiver of the transporting device such that the filling stream impacts against the inner sleeve surface of the container.

2. An arrangement according to claim 1, wherein the positioning device comprises an adjusting device engageable with at least one of the filling nozzle, the container, and the container receiver, said adjusting device being arranged and configured to position the filling nozzle and a bottom of the container in close proximity to one another.

3. An arrangement according to claim 2, further comprising means for returning the adjusting device to a home position.

4. An arrangement according to claim 1, wherein the positioning device comprises an adjusting device engageable with at least one of the filling nozzle, the container, and the container receiver.

5. An arrangement according to claim 4, wherein the filling nozzle is arranged vertically and the adjusting device is arranged and configured to incline the container from a vertical position.

6. An arrangement according to claim 5, wherein the adjusting device comprises a plurality of arms which are engageable with said container. which is engageable with said container.

7. An arrangement according to claim 5, wherein the container receiver comprises a pivotable gripper, and the adjusting device comprises at least one guide bar which is engageable with said container.

8. An arrangement according to claim 7, further comprising means for returning the adjusting device to a home position.

9. An arrangement according to claim 4, further comprising means for returning the adjusting device to a home position.

10. An arrangement according to claim 4, wherein the filling nozzle is pivotable around a swivel axis located proximate the filling opening.

11. An arrangement according to claim 1, wherein said lid comprises a closing element to close said filling opening after the container has been filled.

12. An arrangement according to claim 1, wherein said transporting device is a sequencer table.

13. An arrangement according to claim 1, wherein the container is maintained in a vertical position, and said filling nozzle is fixed at an angle of inclination to the inner sleeve surface of the container.

14. An arrangement for filling containers with a liquid which tends to form foam, comprising:

a transporting device arranged and configured to align a filling opening of a container with a filling nozzle, said transporting device having at least one elastic clamping holder configured to support the container;

a filling nozzle configured to direct a filling stream of a liquid through the filling opening of the container into an inside of the container; and a positioning device arranged and configured to adjust the position of at least one of the filling nozzle and the container with respect to the other of the filling nozzle and the container such that an impact of the filling stream against the inside of the container is reduced.

15. An arrangement for filling containers with a liquid which tends to form foam, comprising:

a transporting device arranged and configured to align a filling opening of a container with a filling nozzle, said filling opening being defined by a lid which covers an end of the container, said filling opening having a cross-sectional area which is less than a cross-sectional area of said lid, said transporting device having at least one container receiver configured to support the container;

a fixed filling nozzle configured to direct a filling stream of a liquid through the filling opening of the container into an inside of the container; and an adjusting device engageable with at least one of the container and the container receiver to position the filling nozzle and a bottom of the container in close proximity to one another such that an impact of the filling stream against the inside of the container is reduced, said adjusting device being configured to vertically displace the container such that a mouth of the filling nozzle extends underneath a level of the liquid in the container.

16. A method for filling containers with a liquid which tends to form foam, said method comprising the steps of:

aligning a filling opening of a container with a filling nozzle by way of a transporting device having at least one container receiver configured to support the container, said filling opening being defined by a lid which covers an end of the container, said filling opening having a cross-sectional area which is less than a cross-sectional area of said lid;

directing a filling stream of a liquid from the filling nozzle through the filling opening of the container into an inside of the container;

adjusting the position of at least one of the filling nozzle and the container with respect to the other of the filling nozzle and the container with a positioning device to form an angle of inclination between the filling nozzle and an inner sleeve surface of the container while the container is being supported by said container receiver of the transporting device such that the filling stream impacts against the inner sleeve surface of the container.

17. A method according to claim 16, wherein said adjusting step comprises engaging an adjusting device of the positioning device with at least one of the filling nozzle, the container, and the container receiver.

18. A method according to claim 17, wherein the filling nozzle is arranged vertically and the adjusting device is arranged and configured to incline the container from a vertical position.

19. A method according to claim 16, further comprising the step of closing said filling opening with a closing element after the container has been filled.

20. A method according to claim 16, wherein said adjusting step further comprises-inclining the container to a predetermined extent during a first filling period until a level of the liquid rises above a contact point of the filling stream with the inner sleeve surface of the container, and successively reducing the incline of the container during a subsequent filling period.

21. A method according to claim 16, wherein said transporting device is a sequencer table.

22. A method according to claim 16, wherein said filling opening is eccentrically positioned relative to a center of said lid.

23. A method according to claim 16, wherein the container receiver comprises a pivotable gripper, and the positioning device comprises at least one guide bar which is engageable with said container.

24. A method for filling containers with a liquid which tends to form foam, said method comprising the steps of:

aligning a filling opening of a container with a filling nozzle by way of a transporting device having at least one container receiver configured to support the container, said filling opening being defined by a lid which covers an end of the container, said filling opening having a cross-sectional area which is less than a cross-sectional area of said lid;

directing a filling stream of a liquid from the filling nozzle through the filling opening of the container into an inside of the container;

engaging an adjusting device with at least one of the filling nozzle, the container, and the container receiver; and positioning the filling nozzle in close proximity to a bottom of the container by way of said adjusting device such that an impact of the filling stream against the inside of the container is reduced.

25. An arrangement for filling containers with a liquid which tends to form foam, comprising:

a transporting device arranged to align a filling opening of a container with a filling nozzle, said transporting device having at least one elastic clamping holder which supports the container;

a filling nozzle arranged to direct a filling stream of a liquid through the filling opening of the container into an inside of the container; and an adjusting device arranged to incline the container with respect to the filling nozzle such that an impact of the filling stream against the inside of the container is reduced.

26. An arrangement according to claim 25, wherein said filling opening is defined by a lid which covers an end of the container, said filling opening having a cross-sectional area which is less than a cross-sectional area of said lid.

27. An arrangement according to claim 25, wherein said transporting device is a sequencer table.

28. A method for filling containers with a liquid which tends to form foam, said method comprising the steps of:

aligning a filling opening of a container with a filling nozzle by way of a transporting device;

supporting the at least one container via an elastic clamping holder;

directing a filling stream of a liquid from the filling nozzle through the filling opening of the container into an inside of the container;

inclining the container with respect to the filling nozzle with a positioning device such that an impact of the filling stream against the inside of the container is reduced.

29. A method according to claim 28, wherein said inclining step further comprises inclining the container to a predetermined extent during a first filling period until a level of the liquid rises above a contact point of the filling stream with the inside of the container, and successively reducing the incline of the container during a subsequent filling period.

30. A method according to claim 28, wherein said filling opening is defined by a lid which covers an end of the container, said filling opening having a cross-sectional area which is less than a cross-sectional area of said lid.

31. A method according to claim 28, wherein said transporting device is a sequencer table.

* * * * *